US008141498B2

(12) United States Patent
Barr et al.

(10) Patent No.: US 8,141,498 B2
(45) Date of Patent: Mar. 27, 2012

(54) RAIL CAR EXTENSION SYSTEM

(76) Inventors: Derrick K. Barr, Crofton, NE (US); Christopher J. McCallum, Yankton, SD (US); David J. Schaefer, Yankton, SD (US)

( * ) Notice: Subject to any disclaimer, the term of this patent is extended or adjusted under 35 U.S.C. 154(b) by 157 days.

(21) Appl. No.: 12/418,895

(22) Filed: Apr. 6, 2009

(65) Prior Publication Data

US 2009/0260538 A1 Oct. 22, 2009

Related U.S. Application Data

(60) Provisional application No. 61/046,581, filed on Apr. 21, 2008.

(51) Int. Cl.
*B61D 17/00* (2006.01)

(52) U.S. Cl. ..... 105/396; 105/399; 105/401

(58) Field of Classification Search ..... 105/396, 105/397, 399, 401, 404, 409, 411; 52/45–56
See application file for complete search history.

(56) References Cited

U.S. PATENT DOCUMENTS 2,645,521 A * 7/1953 Judson ..... 296/185.1
2,685,263 A * 8/1954 Barnes et al. ..... 52/48
2,985,118 A * 5/1961 Maharick et al. ..... 105/377.01
3,881,765 A * 5/1975 Cerra et al. ..... 296/178
4,148,515 A * 4/1979 Knap ..... 296/203.03
4,377,058 A * 3/1983 Hallam et al. ..... 52/45
4,444,123 A * 4/1984 Smith et al. ..... 105/377.01
5,333,554 A * 8/1994 Yamada et al. ..... 105/397
5,488,770 A * 2/1996 Yamada et al. ..... 29/897.2
5,535,680 A * 7/1996 Bieber ..... 105/397
5,577,449 A * 11/1996 Kleiner et al. ..... 105/26.05
5,979,335 A * 11/1999 Saxton et al. ..... 105/404
6,378,444 B1 * 4/2002 Dastas et al. ..... 105/396
7,594,474 B2 * 9/2009 Zupancich ..... 105/377.01
7,789,023 B2 * 9/2010 Forbes ..... 105/396
2002/0170238 A1 * 11/2002 Fecko et al. ..... 52/17
2008/0236439 A1 * 10/2008 Low et al. ..... 105/377.05
2009/0260538 A1 * 10/2009 McCallum et al. ..... 105/377.11
2010/0215425 A1 * 8/2010 Huang et al. ..... 403/24

* cited by examiner

*Primary Examiner* — S. Joseph Morano
*Assistant Examiner* — Jason C Smith
(74) *Attorney, Agent, or Firm* — Dicke, Billig & Czaja, PLLC

(57) ABSTRACT

A rail car extension system including a first main rail section, a second main rail section and a plurality of bow structures. The first main rail section is mounted with respect to an upper surface of the first side wall. The first main rail section includes a first upper rail portion and a first lower rail portion that extends from the first upper rail portion. The second main rail section is mounted with respect to an upper surface of the second side wall. The second main rail section includes a second upper rail portion and a second lower rail portion that extends from the second upper rail portion. The plurality of bow structures are each attached to and extend between the first main rail section and the second main rail section.

17 Claims, 5 Drawing Sheets

RAIL CAR EXTENSION SYSTEM

REFERENCE TO RELATED APPLICATION

This application claims priority to U.S. Provisional Applic. No. 61/046,581, entitled RAIL CAR EXTENSION SYSTEM, which was filed on Apr. 21, 2008, the details of which are incorporated herein by reference.

FIELD OF THE INVENTION

The invention relates generally to a mechanism for enhancing the capacity of vehicles that haul products. More particularly, the invention relates to an extension system for a rail car side or end.

BACKGROUND OF THE INVENTION

When hauling loose flowing bulk commodity products, the amount of product that can be hauled by a vehicle is limited in a variety of ways, the following are the two most prevalent. In a high density load situation the amount of product being transported may be limited by the maximum weight capacity of the vehicle hauling the product. In a low density load situation the amount of product that may be transported is often limited by the cubic volume of the vehicle hauling the product.

There are two primary vehicles used for transporting commodities—rail cars and trailers. With rail cars, the commodities are generally loaded via openings on the top of the rail cars. The commodities are typically unloaded by tipping over the rail car or by opening doors on the bottom of the rail cars.

Unloading by tipping over the rail car often enables the rail car to haul commodities that would not unload well through doors on the bottom of the rail car, i.e. loads that bridge, don't flow well, freeze or stick to the interior require this method, in other cases faster unloading is the primary reason for using doors on the bottom of the rail cars. Tipping over the rail cars places forces on the sides of the rail cars that must be accounted for in the design of the rail car to prevent damage to the rail cars during the tipping process.

The maximum width and length of the rail cars and trailers is typically limited by law or regulation. Accordingly, it is generally not possible to increase the capacity of rail cars and trailers for low density loads by increasing the width and length of the rail cars and trailers.

While there are often restrictions on the height of rail cars and trailers, the rail cars and trailers are often manufactured shorter than the maximum allowed height due to the anticipated commodity that the vehicle was destined to haul. There have been various attempts to increase the capacity of rail cars and trailers by placing extensions on the top of the sides of the rail cars and trailers.

When attaching extensions to rail cars or trailers, it is often desirable for the extension to be removable so that they can be detached when not needed. Additionally, when attaching the rail car extensions to the rail car, it is often desirable to not use attachment mechanisms that could impact the structural integrity of the rail cars.

SUMMARY OF THE INVENTION

An embodiment of the invention is directed to a rail car extension system that includes a first main rail section, a second main rail section and a plurality of bow structures. The first main rail section is mounted with respect to an upper surface of the first side wall. The first main rail section includes a first upper rail portion and a first lower rail portion that extends from the first upper rail portion. The second main rail section is mounted with respect to an upper surface of the second side wall. The second main rail section includes a second upper rail portion and a second lower rail portion that extends from the second upper rail portion. The plurality of bow structures are each attached to and extend between the first main rail section and the second main rail section.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

FIG. 2 is an end view of a main rail section of the rail car extension system of FIG. 1.

FIG. 4 is an end view of a main rail section of the rail car extension system of FIG. 3.

DETAILED DESCRIPTION OF THE PREFERRED EMBODIMENTS

An embodiment of the invention is directed to a side rail extension system, as illustrated at 10 in the Figures. The side rail extension system 10 enables the volume of product that may be transported in the rail car 12 to be increased.

The side rail extension system 10 is particularly suited for use with rail cars 12 having open tops. However, the concepts of the invention may be adapted for use with other transport vehicles such as trailers and cargo boxes on trucks.

Figure 5:
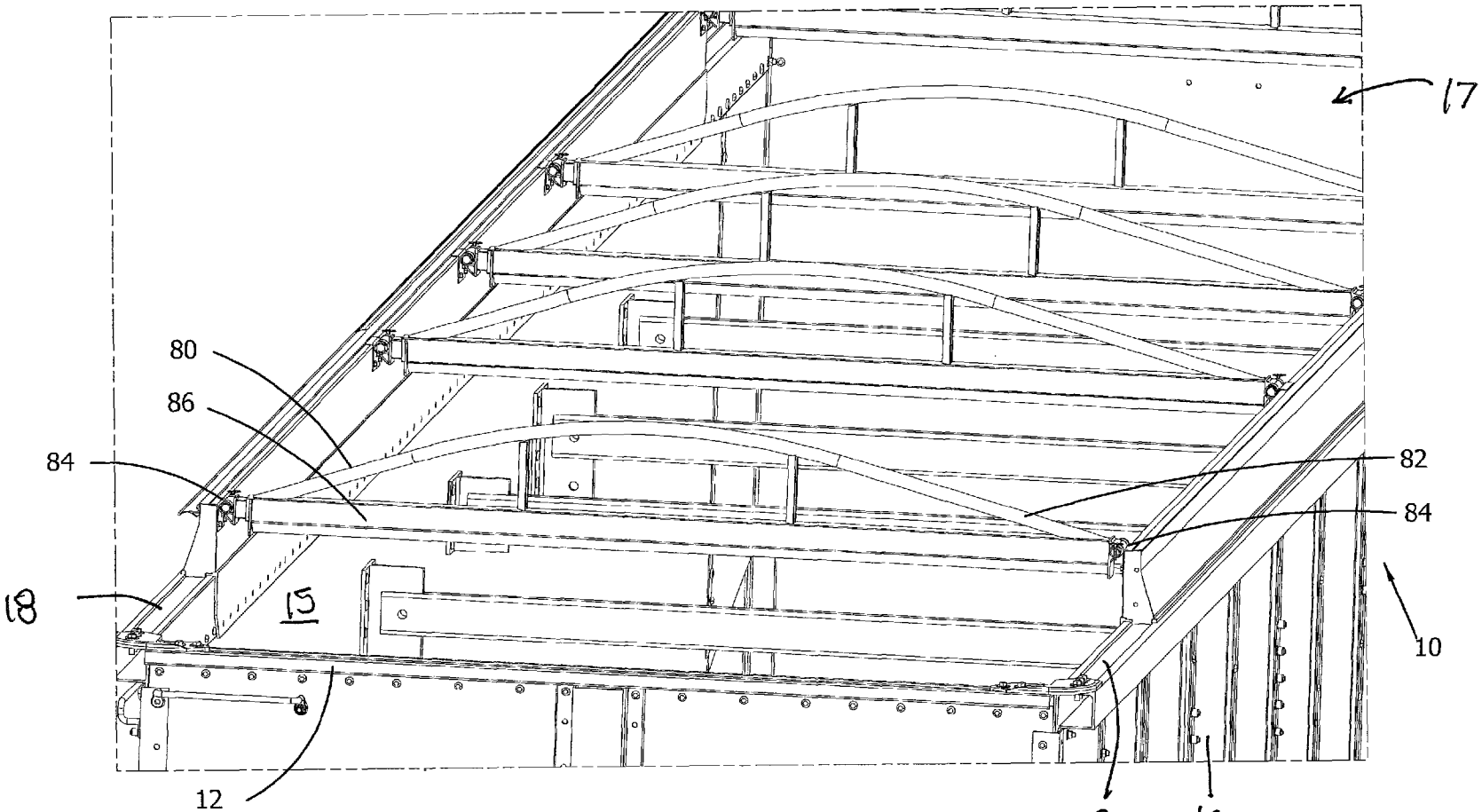
FIG. 5 is a photograph of the rail car extension system of FIG. 3 used in conjunction with a rail car.

The rail car 12 includes a front wall 14, a back wall, a first side wall 15, a second side wall 16 and a bottom wall that define an enclosure with an upwardly directed opening 17, which is illustrated in FIG. 5. The first side wall 15 and the second side wall 16 each have a top plate 18 that is oriented generally transverse to the first side wall 15 and the second side wall 16 to which the top plate 18 is attached. The rail car 12 is capable of receiving a first volume of product.

The concepts of the invention are also adapted for use with rail cars 12 that unload products hauled therein by tipping or rotating the rail cars 12 so that the rail car 12 is at least partially inverted. The concepts of the invention may also be used in conjunction with rail cars that unload products using doors on the bottom of the rail cars.

Figure 1:
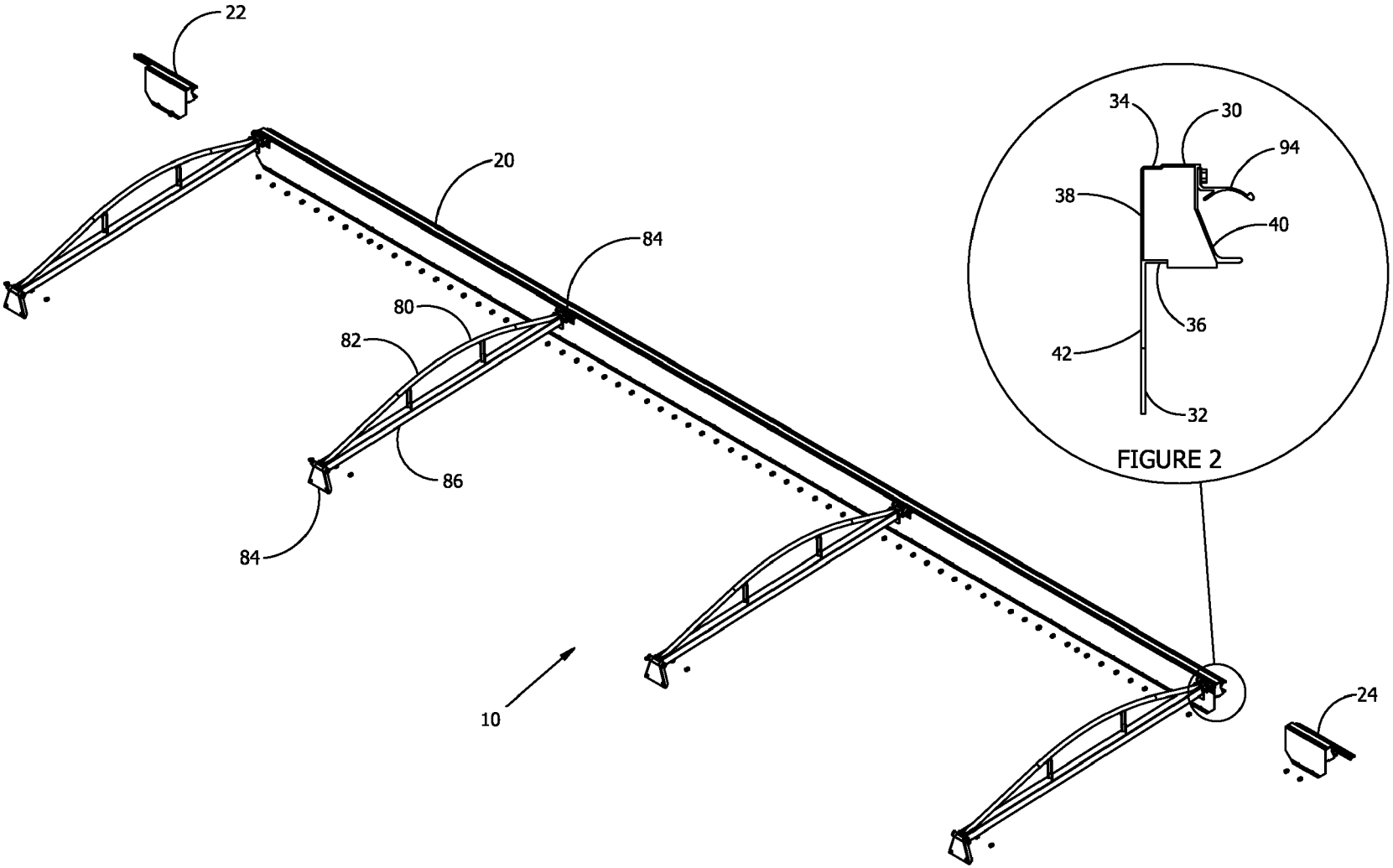
FIG. 1 is a perspective view of a rail car extension system that includes a single side rail according to an embodiment of the invention.
Figure 3:
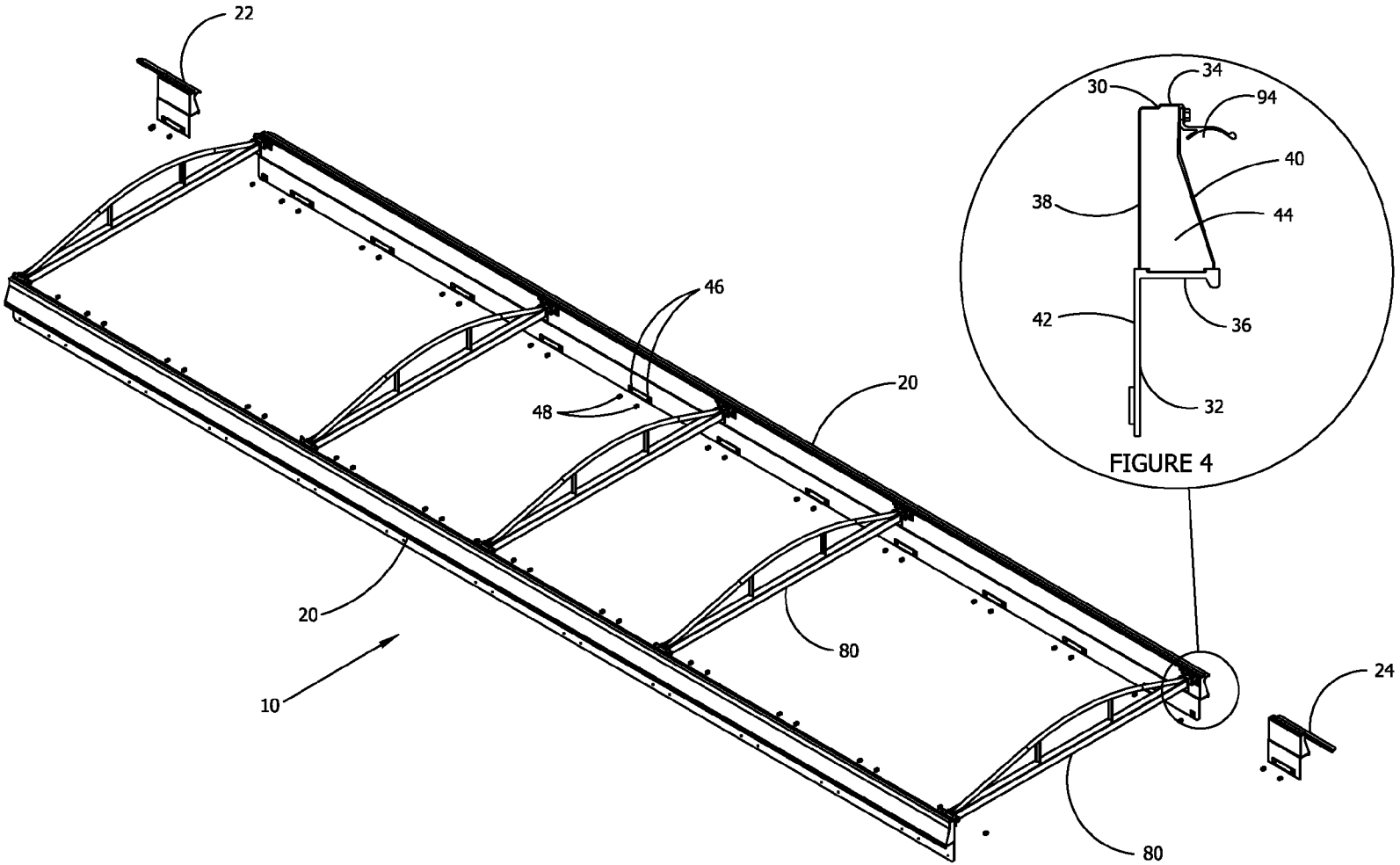
FIG. 3 is a perspective view of a rail car extension system that includes two side rails according to another embodiment of the invention.

The side rail extension system 10 generally includes a main rail section 20, as illustrated in FIGS. 1 and 3. The main rail section 20 may extend substantially between the ends of the rail car 12. Depending on the application, the main rail sections 20 used on opposite sides of the rail car 12, such as illustrated in FIG. 3, may have different heights.

The main rail section 20 may include an upper rail portion 30 and a lower rail portion 32. In one configuration, the upper rail portion 30 has a top panel 34, a bottom panel 36 and a pair of side panels 38, 40 that may be connected in a generally rectangular shape. Forming the upper rail portion 30 with the preceding configuration provides the main rail section 20 with sufficient strength to resist deformation when transporting products in the rail car 12 as well as tipping the rail car 12 to remove the products from the rail car 12.

The bottom panel 36 is oriented substantially transverse to the lower rail portion 32 proximate the intersection of the upper rail portion 30 and the lower rail portion 32, as illustrated in FIG. 4. When the main rail section 20 is attached to first side wall 15 and the second side wall 16, as illustrated in FIG. 5, the bottom panel 36 is adjacent to the top plate 18.

The main rail section 20 may include a leg 42 extending from a lower surface of the upper rail portion 30 opposite the lower rail portion 32, as illustrated in FIGS. 2 and 4. The leg 42 supports the main rail section 20 and thereby prevents the main rail section 20 from pivoting with respect to the rail car 12. The main rail section 20 may include an end panel 44 that prevents objects from entering into the region defined by the top panel 34, the bottom panel 36 and the side panels 38, 40.

The lower rail portion 32 extends from and may be integrally formed with the upper rail portion 30. The lower rail portion 32 facilitates attachment of the main rail section 20 to the rail car 12 but also may enhance the strength of the main rail section 20. The lower rail portion 32 may include a plurality of apertures 46 to facilitate attachment of the main rail section 20 to the rail car 12 using bolts 48 or other fastening devices.

The main rail section 20 may be fabricated from using a variety of techniques and materials. In one configuration, the main rail section 20 has a substantially consistent shape along the length thereof. This configuration facilitates fabricating the main rail section 20 using extrusion. Examples of materials that may be used to fabricate the main rail section 20 are aluminum, fiberglass, plastic composite and steel.

Figure 7:
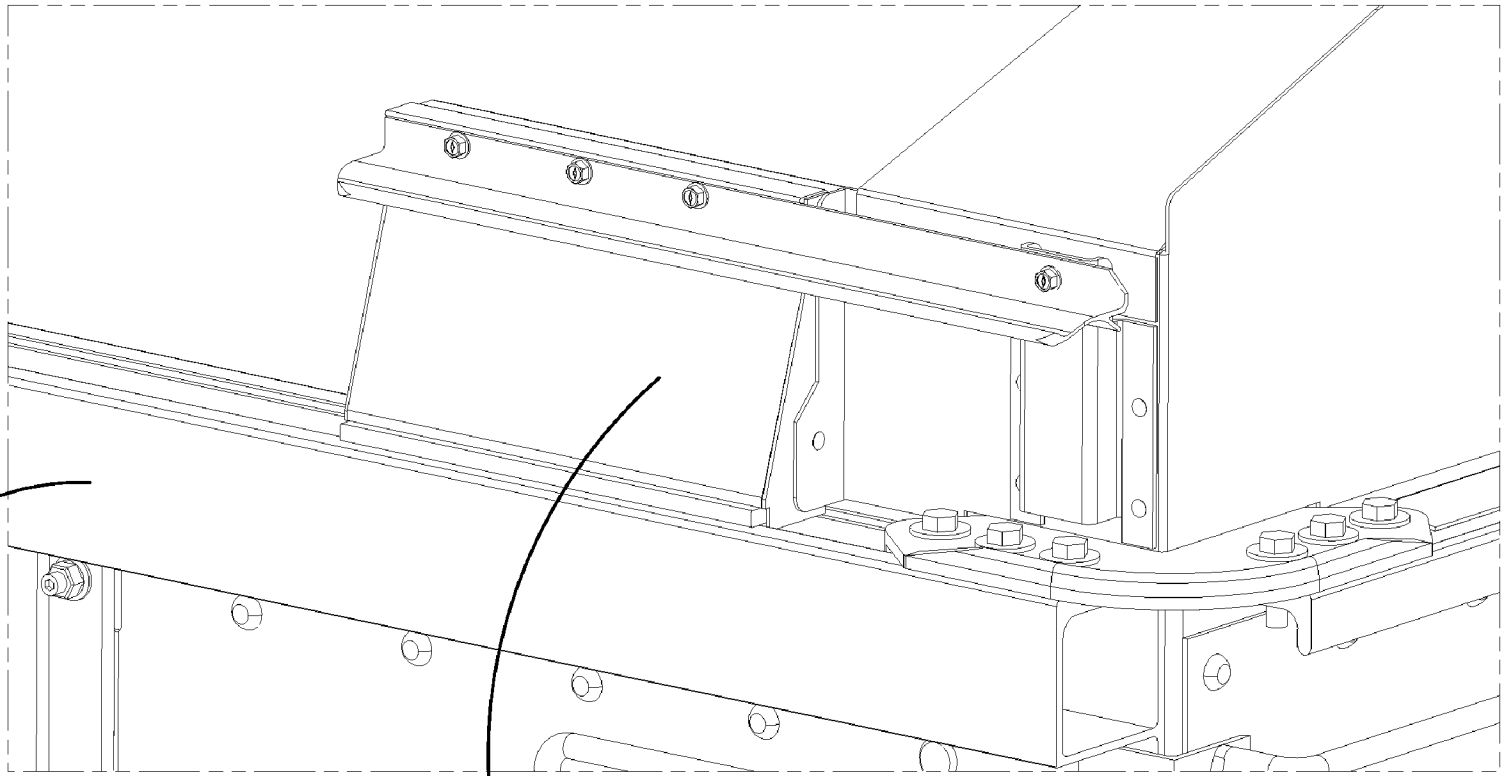
FIG. 7 is an enlarged photograph of an end rail section of the rail car side extension.

For rotary tipper cars, the system may include a first end rail section 22 and a second end rail section 24 to clear clamps, as illustrated in FIGS. 1 and 3. The first end rail section 22 and the second end rail section 24 are attached to the rail car 12 proximate the front and back ends thereof, as illustrated in FIGS. 1 and 7. The first end rail section 22 and the second end rail section 24 may be shaped substantially similar to each other but are mirror images to each other.

The first end rail section 22 and the second end rail section 24 may have a profile that is similar to the profile of the main rail section 20. The first end rail section 22 and the second end rail section 24 are used to adapt the side rail extension system 10 for rail cars 12 having different lengths.

The side rail extension system 10 may include at least one bow structure 80 that extends between the main rail section 20, as illustrated in FIGS. 1 and 3. The at least one bow structure 80 may support a cover that is placed over the rail car 12. The number of bow structures 80 used in the side rail extension system 10 may depend on a variety of factors such as the length of the rail car 12 and the weight of material being transported in the rail car 12.

The at least one bow structure 80 may include a central bow region 82 and a pair of bow attachment regions 84. The central bow region 82 may have a variety of configurations such as tubular or solid, and may have a convex shape. To further strengthen the central bow region 82 a cross bar 86 may be attached hereto. The cross bar 86 may be substantially straight and may extend substantially between the ends of the central bow region 82.

The bow attachment regions 84 facilitate attachment of the central bow region 82 to the main rail section 20. The bow attachment regions 84 may include a first attachment section 90 and second attachment section 92 that are pivotally attached to each other.

Figure 6:
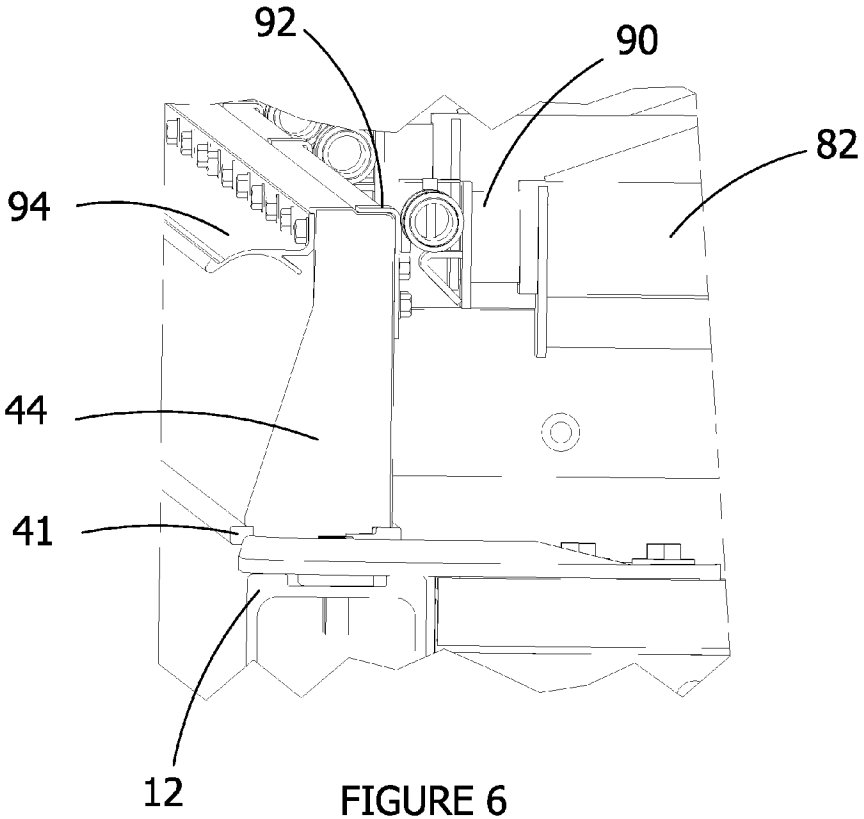
FIG. 6 is an enlarged photograph of the main rail section.

The first attachment section 90, as most clearly illustrated in FIG. 6, may be slidably mounted to not transfer any loading to the bow from the flexing sides of the rail car. This feature could also enable the side rail extension system 10 to be used in conjunction with rail cars 12 having slightly different widths. The second attachment section 92 may have an L-shape to be placed adjacent to the top panel 38 and the side panel 42. The second attachment section 92 may be attached to the main rail section 20 using a variety of mechanisms such as using bolts (not shown).

The side rail extension system 10 may include a latch plate 94, as illustrated in FIGS. 2, 4 and 6. The latch plate 94 may have an arched configuration. The latch plate 94 may be attached to the main rail section 20 proximate an upper surface thereof and may extend substantially along the length of the main rail section 20. The position of the latch plate 94 may be recessed with respect to an edge of the rail car 12 so that the overall width of the rail car 12 with the side rail extension system 10 attached thereto does not extend beyond required dimensions.

A leg 41 may also be provided on the lower surface of the main rail section 20 that is opposite the leg 42, as illustrated in FIG. 6. The leg 41 supports the main rail section 20 in a generally parallel orientation with respect to the rail car 12.

A gap may be provided between the main rail section 20 and the first end rail section 22 and the second end rail section 24, as illustrated in FIG. 7 to provide a location for clamping the rail car 12 to facilitate tipping the rail car 12 to remove the contents therefrom.

Once the main rail sections 20 are attached to the first side wall and the second side wall, the rail car 12 has an increased capacity such that the rail car is capable of receiving a second volume of product that is larger than the first volume of product.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. An increased capacity rail car system comprising:

an open top rail car comprising a front wall, a back wall, a first side wall, a second side wall and a bottom wall that define an enclosure with an upwardly directed opening, wherein the first side wall has a first top plate and wherein the second side wall has a second top plate; and a rail car extension system comprising:

a first main rail section comprising:

a first upper rail portion;

a first lower rail portion that extends from the first upper rail portion; and a first bottom panel that is oriented substantially transverse to the first lower rail portion proximate an intersection of the first upper rail portion and the first lower rail portion, wherein the first lower rail portion has a first aperture formed therein, wherein the first bottom panel is positioned adjacent to the first top plate and wherein the first main rail section is mounted to the first side wall by extending a first fastener through the first aperture and into the first side wall;

a second main rail section comprising;

a second upper rail portion;

a second lower rail portion that extends from the second upper rail portion and a second bottom panel that is oriented substantially transverse to the second lower rail portion proximate an intersection of the second upper rail portion and the second lower rail portion, wherein the second lower rail portion has a second aperture formed therein, wherein the second bottom panel is positioned adjacent to the second top plate and wherein the second main rail section is mounted to the second side wall by extending a second fastener through the second aperture and into the second side wall; and a plurality of bow structures that are each attached to and extend between the first main rail section and the second main rail section.

2. The increased capacity rail car system of claim 1, wherein at least one of the first upper rail portion and the second upper rail portion comprises a first side panel, a second side panel, a top panel and the bottom panel that are attached to each other so that the first side panel and the second side panel each extend between the top panel and the bottom panel.

3. The increased capacity rail car system of claim 2, wherein a width of the first upper rail portion and the second upper rail portion is greater proximate the top panel than proximate the bottom panel.

4. The increased capacity rail car system of claim 1, and further comprising a latch plate that extends from an outer surface of at least one of the first main rail section and the second main rail section.

5. The increased capacity rail car system of claim 1, wherein the plurality of bow structures are pivotally attached to the first main rail section and the second main rail section.

6. The increased capacity rail car system of claim 1, wherein the plurality of bow structures each include a central bow, a first attachment region and a second attachment region and wherein the central bow extends between the first attachment region and the second attachment region.

7. The increased capacity rail car system of claim 6, wherein the central bow is arched such that ends of the central bow are lower than a central portion of the central bow, and wherein the plurality of bow structures each further comprise a cross bar that extends between the first attachment region and the second attachment region.

8. The increased capacity rail car system of claim 1, and further comprising at least one end rail section mounted with respect to at least one of the first side wall and the second side wall, wherein the end rail section is aligned with and spaced-apart from the main rail section.

9. The increased capacity rail car system of claim 8, wherein the end rail section includes an end upper rail portion, an end lower rail portion that extends from the end upper rail portion and a bottom panel that extends from the end rail section proximate an intersection of the end upper rail portion and the end lower rail portion.

10. The increased capacity rail car system of claim 1, and further comprising a cover that extends at least partially over the first main rail section, the second main rail section and the plurality of bow structures to substantially cover the rail car.

11. A method of increasing capacity of an open top rail car that includes a front wall, a back wall, a first side wall, a second side wall and a bottom wall that define an enclosure with an upwardly directed opening, wherein the first side wall has a first top plate and wherein the second side wall has a second top plate and wherein the method comprises:

providing a first main rail section comprising a first upper rail portion, a first lower rail portion that extends from the first upper rail portion and a first bottom panel that is oriented substantially transverse to the first lower rail portion proximate an intersection of the first upper rail portion and the first lower rail portion, wherein the first lower rail portion has a first aperture formed therein;

providing a second main rail section comprising a second upper rail portion, a second lower rail portion that extends from the second upper rail portion and a second bottom panel that is oriented substantially transverse to the second lower rail portion proximate an intersection of the second upper rail portion and the second lower rail portion, wherein the second lower rail portion has a second aperture formed therein;

positioning the first bottom panel adjacent to the first top plate;

positioning the second bottom panel adjacent to second top plate;

extending a first fastener through the first aperture and into the first side wall to attach the first extension section to the first side wall;

extending a second fastener through the second aperture and into the second side wall to attach the second extension section to the second side wall; and attaching a plurality of bow structures to extend between the first main rail section and the second main rail section.

12. The method of claim 11, and further comprising attaching a latch plate to an outer surface of at least one of the first main rail section and the second main rail section.

13. The method of claim 11, wherein the plurality of bow structures are pivotally attached to the first main rail section and the second main rail section.

14. The method of claim 11, wherein the plurality of bow structures each include a central bow, a first attachment region and a second attachment region and wherein the central bow extends between the first attachment region and the second attachment region, wherein the central bow is arched such that ends of the central bow are lower than a central portion of the central bow.

15. The method of claim 14, and further comprising attaching a cross bar to the first attachment region and the second attachment region.

16. The method of claim 11, and further comprising mounting at least one end rail section with respect to at least one of the first side wall and the second side wall, wherein the end rail section is aligned with and spaced-apart from the main rail section.

17. The method of claim 11, and further comprising extending a cover at least partially over the first main rail section, the second main rail section and the plurality of bow structures to substantially cover the rail car.

* * * * *